United States Patent [19]

Piana et al.

[11] Patent Number: 4,852,588

[45] Date of Patent: Aug. 1, 1989

[54] ROD DEFLECTING AND BREAKING DEVICE IN A CIGARETTE MAKING MACHINE

[75] Inventors: Maurizio Piana, Casalecchio di Reno; Renato Manservisi, Bologna, both of Italy

[73] Assignee: SASIB S.p.A., Bologna, Italy

[21] Appl. No.: 167,985

[22] Filed: Mar. 14, 1988

[30] Foreign Application Priority Data

Apr. 17, 1987 [IT] Italy ..... 12467 A/87

[51] Int. Cl.[4] ..... A24C 5/18

[52] U.S. Cl. ..... 131/84.1; 131/96

[58] Field of Search ..... 131/83, 84.1, 84.4, 131/95, 96; 83/371, 591, 663

[56] References Cited

U.S. PATENT DOCUMENTS

| | | | |
|---|---|---|---|
| 4,188,957 | 2/1980 | Legardidier | 131/96 |
| 4,261,790 | 4/1981 | Brinker et al. | 131/96 X |
| 4,278,100 | 7/1981 | Thatcher | 131/96 |
| 4,406,293 | 9/1983 | Maldina | 131/84.1 |
| 4,485,827 | 12/1984 | Komossa et al. | 131/96 X |

FOREIGN PATENT DOCUMENTS

| | | | |
|---|---|---|---|
| 1133455 | of 0000 | Italy . | |
| 1581723 | 12/1980 | United Kingdom | 131/84.1 |

*Primary Examiner*—V. Millin
*Assistant Examiner*—Robert W. Bahr
*Attorney, Agent, or Firm*—Larson and Taylor

[57] ABSTRACT

The invention refers to a continuous cigarette rod deflecting and breaking device in a cigarette making machine, which device (1) is arranged upstream of the unit for cutting the rod (B) into individual cigarette lengths, and comprises a deflecting member (2) which upon control is movable between an uplifted active position in which it downwardly deflects the rod from its normal path along the rod-forming line (L), and a lowered down rest position in which it is located under the normal rod path, and leaves the rod free to travel toward the cutting unit. The said deflecting member (2) is integral with a severing element (6) which is caused to cross the path of rod (B) so as to cut the said rod as the deflecting member (2) is moved either from its uplifted active position into its lowered down rest position, or from its lowered down rest position into its uplifted active position. According to the invention, a deflecting and breaking device of the above stated type is provided under the deflecting member (2) with a rod-breaking contrivance (9) which is adapted for breaking up, particularly for cutting into single lengths or longitudinally open the rod (B) having been deflected by the deflecting member (2).

5 Claims, 4 Drawing Sheets

ROD DEFLECTING AND BREAKING DEVICE IN A CIGARETTE MAKING MACHINE

SUMMARY OF THE INVENTION

The invention refers to a continuous cigarette rod deflecting and breaking device in a cigarette making machine, which device is arranged upstream of the unit for cutting the rod into individual cigarette lengths, and comprises a rod-deflecting member which upon control is movable between an uplifted active position in which it downwardly deflects the rod from its normal path along the rod-forming line (L), and a lowered down rest position, in which it is located under the normal rod path and leaves the rod free to travel toward the cutting unit, the said deflecting member being integral with a severing element which is caused to cross the rod path so as to cut the rod as the deflecting member is moved either from its uplifted active position into its lowered down rest position, or from its lowered down rest position into its uplifted active position.

A deflecting and breaking device of this type is known, for example, from the Italian Pat. No. 1.133.455, and the following is the operation of said device: when during the starting step of the cigarette making machine the rod still is not correctly sealed, the deflecting member is located in its uplifted active position and deflects downwardly the still imperfect rod. As soon as the correctly sealed condition of the rod is attained, the deflecting member is moved downward together with the severing element, which cuts the deflected rod while the deflecting member is being moved into its lowered down rest position under the normal rod path, so that the rod is allowed to proceed toward the unit for cutting the rod into individual cigarette lengths. When the cigarette making machine is stopped upon control of the operator or upon control of a checking sensor, such as, for example, a sensor that decides to halt the cigarette flow downstream of the cutting unit, because of accidental circumstances, the deflecting member is moved into its uplifted active position, and the severing element cuts the rod which is thus deflected downward by the deflecting member. On restarting the regular operation of the cigarette making machine, the deflecting member is again cause to descend into its lowered down rest position under the normal rod path toward the cutting unit, and the severing element cuts the deflected rod length.

In the rod deflecting and breaking devices of the above stated kind, the rod having been downwardly deflected by the deflecting member is collected into an underlying rod-collecting receptable. In high duty cigarette making machines, for example with an output of 10,000–12,000 cigarettes per minute, the rod length which is deflected at each stopping of the machine may be as long as some tens of meters, for example, 35–45 meters, owing to the high speed of the rod, and the some seconds time which is required for entirely stopping the cigarette making machine, notwithstanding the action of suitable braking means.

The collection of a so long continuous rod length into the rod-collecting receptable may be the cause of some problems.

Moreover, in the instance of the operating machine being stopped, for example, owing to an accidental interruption of the cigarette flow, the initial portion of the deflected rod is sealed, and then rigid, owing to the delay in de-activating (uplifting) the paste drier. Therefore, the leading end of the deflected rod roughly hits against the bottom of the rod-collecting receptable, and produces a deformation upstream of the rod which thus takes an undulatory shape along the rod-forming channel. Such a deformation is the cause of cloggings, and the same delays the restarting of the regular operation of the machine.

The operation of the invention is to elminate the above stated inconveniences, more particularly, the invention aims to postpone as far as possible the de-activation (uplifting) of the paste drier when the cigarette making machine is stopped, in order to favour a ready restarting of the same, while however avoiding the hitting of the leading end of the deflected rod against the bottom of the rod-collecting receptable, and the resulting deformation of the rod along the rod forming line.

This problem is solved by the invention with the feature that the rod deflecting and breaking device of the type as described in the preamble, in provided under the rod deflecting member with a rod-breaking contrivance which is adapted for breaking up the rod having been deflected by the deflecting member. The construction and the operation of the rod-breaking contrivance according to the invention may be practised in more different manners. Thus, for example, according to one embodiment of the invention, the rod-breaking contrivance comprises means for cutting into pieces or breaking up the deflected rod, and may consist of a reciprocatable or rotary cutter mechanism that cuts off the deflected rod into successive single pieces of any suitable reduced length. In another embodiment of the invention, the rod-breaking means may longitudinally open the deflected rod to eliminate its stiffness, and may consist of at least one stationary knife, or the like, longitudinally cutting the rod paper.

BRIEF DESCRIPTION OF THE DRAWINGS

These and other features of the invention and the advantages arising therefrom will appear in more detail from the following specification of some embodiments thereof, which are shown by way of examples in the accompanying drawings, in which.

DESCRIPTION OF THE PREFERRED EMBODIMENTS

Figure 1:
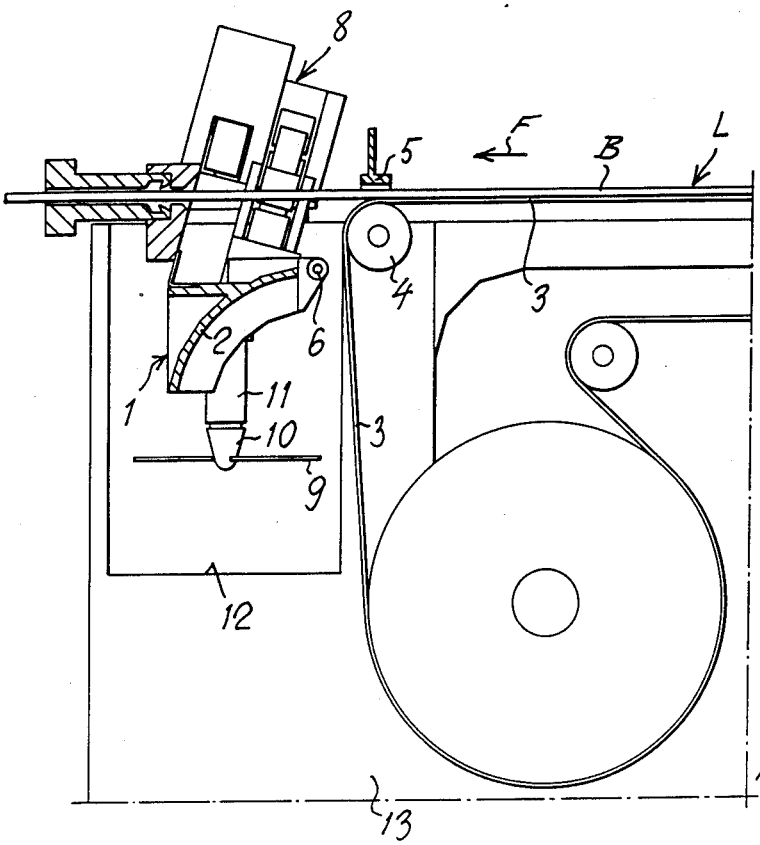
FIGS. 1 and 2 show in a vertical longitudinal section a first embodiment of the rod deflecting and breaking device in a cigarette making machine, with the rod deflecting member in its lowered down rest position (FIG. 1) and in its uplifted active position (FIG. 2).
Figure 2:
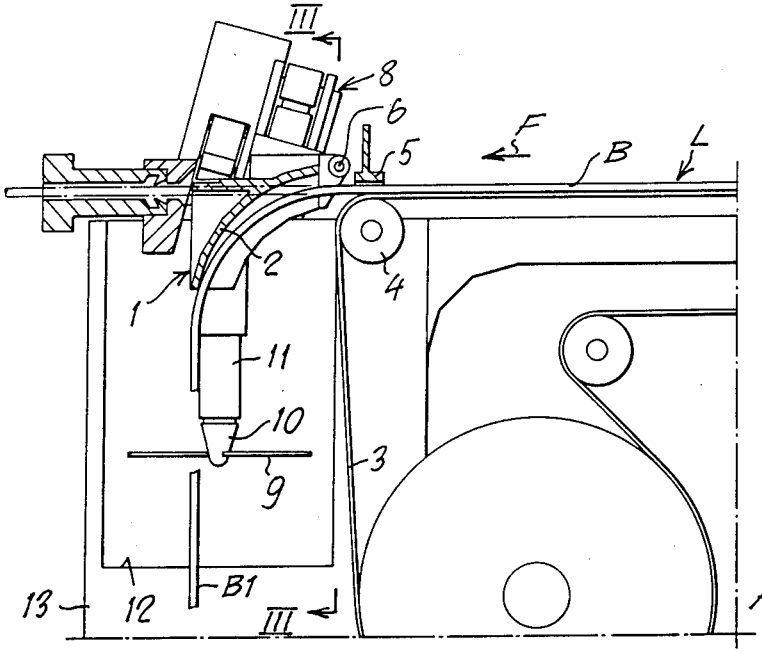

Referring to FIGS. 1 and 2, the device 1 for deflecting and breaking the continuous cigarette rod B is arranged at the outlet end of the line L on which the said rod B is formed, upstream of the cutting unit (not shown) for cutting the rod into individual cigarette lengths. This deflecting and breaking device 1 consists of a deflecting member 2 in form of an overturned arcuate channel having its inlet end turned toward the rod-forming line L and its outlet end turned downward. Shown at 3 is the endless band supporting the rod B in correspondence of the rod-forming line L, and which at the end of said line is deviated therefrom around the guide pulley 4. Over the said guide pulley 4 a fixed abutment 5 is provided, which in the fashion of a counterblade cooperates with a severing element 6 mounted onto the deflecting member at the top of its inlet end, and which in the shown embodiment consists of a transversely arranged rotatable roller.

The deflecting member 2 is movable along the longitudinal vertical plane of the rod-forming line L, preferably in a direction that is slightly inclined with respect to the perpendicular to the said line L, so as to be alternately caused to take a lowered down rest position and an uplifted active position.

Figure 3:
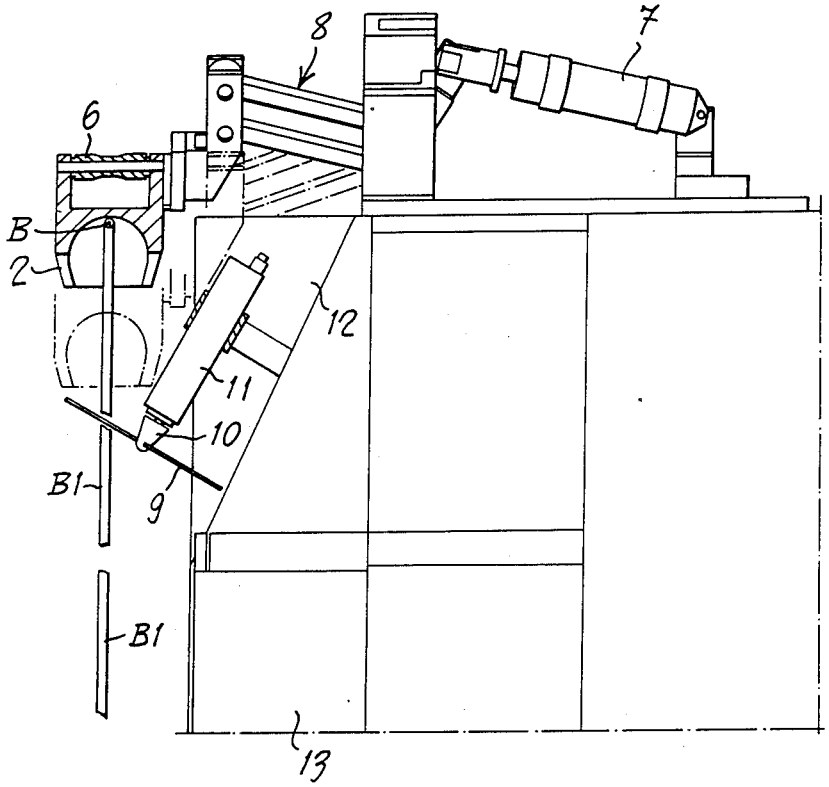
FIG. 3 is a vertical cross-section of the said device, taken on line III—III in FIG. 2.

In its lowered down rest position shown in FIG. 1 and with dash-and-dot lines in FIG. 3, the deflecting member 2 and the severing roller 6 are located under the normal straight path of rod B along the rod-forming line L toward the cutting unit, and are positioned slightly forward of the guide pulley 4 for band 3, with reference to the travel direction F of rod B. In this lowered down rest position the deflecting member 2 and the severing roller 6 do not interfere with the normal movement of rod B along its straight path toward the cutting unit. In its uplifted active position shown in FIG. 2 and with solid lines in FIG. 3, the deflecting member 2 has its inlet end located at the level of the straight path of rod B along the rod forming line L, so that it intercepts and deflects downwardly the said rod B, as shown in FIG. 2 and with solid lines in FIG. 3. In this uplifted active position of the deflecting member 2, the severing roller 6 is located above the rod forming line L and above the rod B, and is nearer to the guide pulley 4 or it is even located partly above the said pulley 4, since the direction of the ascending movement of the deflecting member 2 from its rest to its active position is upwardly inclined to the rear, i.e., in the opposite direction to the forward direction F of rod B. When the deflecting member 2 is moved upwardly from its lowered down rest position to its uplifted active position, the severing roller 6 cuts the rod B by cooperating with the counterblade formed by the stationary abutment 5. When the deflecting member 2 is moved downwardly from its uplifted active position into its lowered down rest position, the severing roller 6 again cuts the rod B, this time by cooperating with the guide pulley 4.

The above described movements of the deflecting member 2 between its lowered down rest position and its uplifted active position may be obtained with any suitable device, for example, in known manner by means of a double-acting, either pneumatic or hydraulic actuating cylinder 7 and a drive unit 8.

Underneath the deflecting member 2 a rod-breaking contrivance is provided, which is adapted for breaking up or cutting into pieces the downwardly deflected rod B issuing from the deflecting member 2. In the embodiment according to FIGS. 1 to 3, the said rod-breaking contrivance consists of a whip cutter mechanism, i.e. of a rotary head 10 carrying one or more radial or diametric rods 9, and which is driven at a high speed by a motor 11, preferably consisting of readily started motor, such as a pneumatic blade motor.

The rotary whip member or members or rods 9 are preferably made form a not metallic material, particularly from a plastics material, such as Nylon or Derlin. The motor 11 is at least partly housed within a recess 12 in the machine frame 13, and is supported in an inclined position.

When the deflecting member 2 is in its lowered down rest position, the rod-breaking contrivance which is associated therewith, i.e., the motor 11 and the head 10 with the whip member or members or rods 9, are stationary.

Simultaneously with the upward movement of the deflecting member 2, for example, in the instance of a stopping of the cigarette making machine, also the motor 11 is started and readily sets in rotation the head 10 with the whip member or members or rods 9, which while being rotated are caused to cross the path of rod B having been downwardly deflected by the deflecting member 2, and cut this rod into successive, relatively short single pieces or lengths B1.

When the cigarette making machine is restarted and the deflecting member 2 is moved into its lowered down rest position, the motor 11 and so the rotation of head 10 with the whip member or members or rods 9 are stopped simultaneously with the lowering down of the deflecting member 2, or with a slight delay.

In the embodiment according to FIGS. 4 to 7, the rod deflecting and breaking device 1 is made and operates in the same manner as above described, its several components being designated by the same reference numerals as used in FIGS. 1 to 3.

Figure 4:
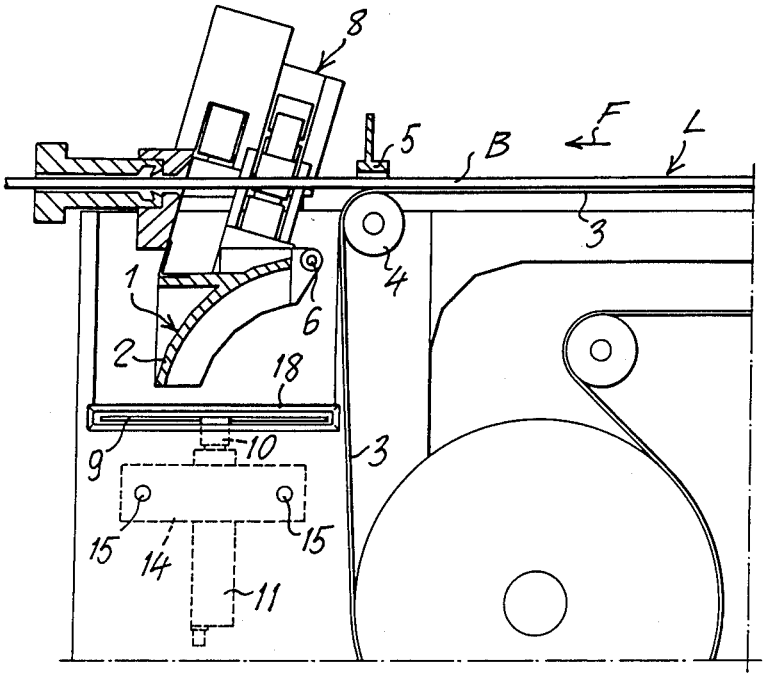
FIGS. 4 and 5 are vertical longitudinal sections showing a further embodiment of the rod deflecting and breaking device according to the invention, with the rod deflecting member in its lowered down rest position (FIG. 4) and in its uplifted active position (FIG. 5).
Figure 5:
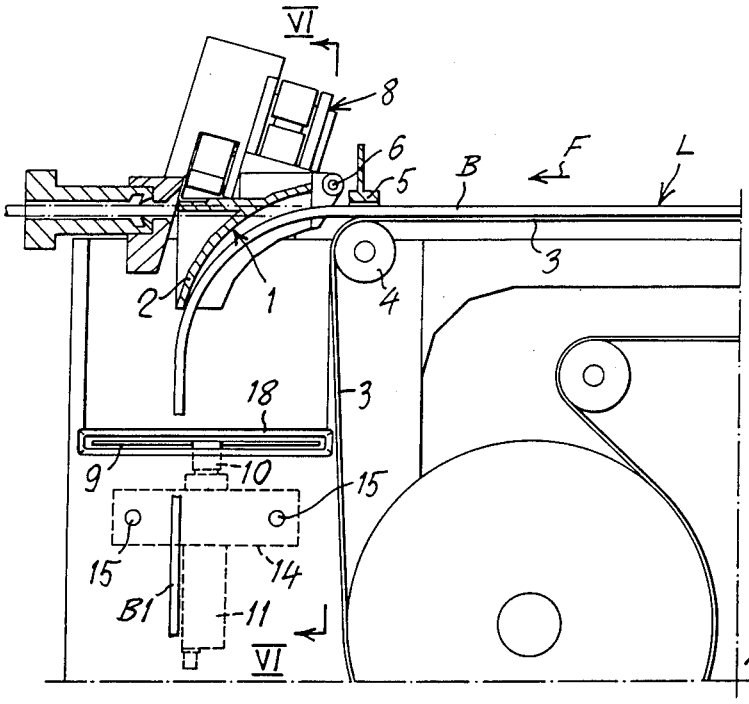
Figure 6:
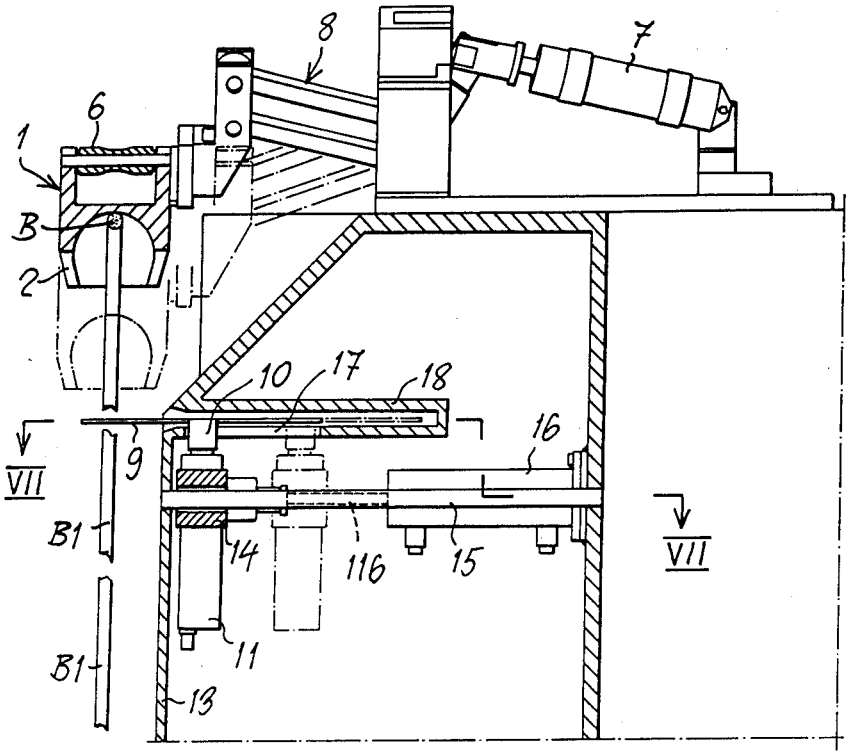
FIG. 6 is a vertical cross-section of the said device, taken on line VI—VI in FIG. 5.
Figure 7:
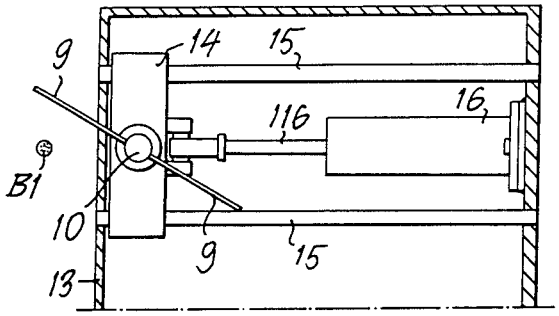
FIG. 7 is a horizontal section taken on line VII—VII in FIG. 6.

The rod deflecting member 2 is shown in its lowered down rest position in FIG. 4 and with dash-and-dot lines in FIG. 6, while the uplifted active position of the deflecting member 2 is shown in FIG. 5 and with solid lines in FIG. 6. The rod breaking contrivance arranged under the rod deflecting and breaking device 1, and according to FIGS. 4 to 7, is however constructed differently from the one shown in FIGS. 1 to 3.

Also the rod breaking contrivance according to FIGS. 4 to 7 consists of a whip cutter mechanism comprising a readily started motor 11 driving in rotation a head 10 provided with one or more whip members or rods 9, however, the axis of rotation of motor 11 and of head 10 here is substantially vertical, not inclined as in the embodiment according to FIGS. 1 to 3. Moreover, the whole of the whip cutter mechanism (i.e., the motor 11 with the head 10 and the whip member or members or rods 9) is carried by a slide 14 which is movable across the path of the deflected rod B under the deflecting member 2, more particularly, it is slidably mounted on to two substantially horizontal parallel guide rods 15 fastened to the machine frame 13. The movement of slide 14 toward the path of the deflected rod B and backward, is performed by means of a double-acting, either pneumatic or hydraulic actuating cylinder 16 fastened to the machine frame 13 between the two guide rods 15, while its piston stem 116 is pivotally connected to the slide 14.

Through a slot 17, the rotary head 10 of this whip cutter mechanism extends from below into an overlying protective sheath 18 which is attached to the machine frame 13, and in which also the whip member or members or rods 9 are positioned. This protective sheath 18 is open in the direction of the path of rod B being downwardly deflected by the deflecting member 2.

In this embodiment according to FIGS. 4 to 7, when the deflecting member 2 is in its lowered down rest position, the slide 14 is moved by the actuating cylinder 16 into a retracted rest position away from the path of the deflected rod B, which is shown by dash-and-dot lines in FIG. 6. In this retracted rest position the whip member or members or rods 9 of head 10 are housed within the protective sheath 18, and therefore they are inaccessible. When the deflecting member 2 is in its uplifted active position, the slide 14 is moved by the actuating cylinder 16 into an advanced active position toward the path of the deflected rod B, which is shown by solid lines in FIGS. 6 and 7. In this advanced, active position, the whip member or members or rods 9 of the rotary head 10 are caused to extend from the protective sheath 18 into the path of rod B having been deflected by the deflecting member 2, and cut the said rod B into successive, relatively short single pieces or lengths B1.

In this embodiment according to FIGS. 4 to 7, thanks to the protective sheath 18, the whip member or members or rods 9 of the rotary rod-breaking contrivance may be made even from a metallic material, and may consist of blades or knives. Moreover, the said whip member or members, rods, or blades 9 may be driven continuously by the motor 11, i.e., they may be rotated even when they are in their retracted rest position within the protective sheath 18, whereby the rod-breaking contrivance can be caused to more quickly operate on the deflected rod for breaking it into pieces, when the deflecting member 2 is moved into its uplifted active position, and/or the motor 11 for the rod-breaking cutter 9,10 may even not be a readily started motor.

We claim:

1. A continuous cigarette rod deflecting and breaking device for a cigarette making machine, which device is located upstream of a unit for cutting a tobacco-containing rod travelling horizontally along a rod-forming line into individual cigarette lengths, the device comprising:

a deflecting member movable between an upper active position wherein said deflecting member downwardly deflects the tobacco-containing rod from its normal path along the rod-forming line along a deflected path, and a lower rest position wherein said deflecting member is located below the normal path along the rod-forming line leaving the tobacco-containing rod free to travel toward the cutting unit, said deflecting unit including an integral severing element located such that said severing element crosses the normal path along the rod-forming line so as to cut the road as said deflecting member is moved from one position to the other position, and a rod breaking apparatus adapted for breaking up the rod which has been deflected by said deflecting member along the deflected path, said rod breaking apparatus including a rotary element driven by a motor and at least one rotary cutting member extending radially with respect to an axis of rotation of said rotary element and which is caused to cross the deflected path, said rotary element being mounted in a stationary position and capable of being set in rotation simultaneously with the movement of said deflecting member from its lower rest position to its upper active position, and capable of being stopped simultaneously with the movement of said deflecting member from its upper active position to its lower rest position.

2. The device according to claim 1 wherein said at least one rotary cutting member is selected from the group consisting of blades, whip members, and rods.

3. A continuous cigarette rod deflecting and breaking device for a cigarette making machine, which device is located upstream of the unit for cutting the tobacco-containing rod into individual cigarette lengths, the device comprising a deflecting member movable between an upper active position wherein said deflecting member downwardly deflects the tobacco-containing rod from its normal path along the rod-forming line, and a lower rest position wherein said deflectintg member is located below the normal path along the rod-forming line leaving the tobacco-containing rod free to travel toward the cutting unit, said deflecting member including an integral severing element located such that said severing element crosses the path along the rod-forming line so as to cut the rod as said deflecting member is moved from one position to the other position; and a rod-breaking apparatus adapted for breaking up the rod which has been deflected by said deflecting member, said rod-breaking apparatus including a rotary cutting element driven by a motor and provided with at least one rotary cutting member selected from the group consisting of blades, whip members and rods extending radially with respect to the axis of rotation of said rotary element and which is caused to cross the path of the deflected rod, said rotary cutting element being mounted so as to be movable transversely to the path of the rod deflected by said deflecting member from a first, advanced active position across the path of the deflected rod to a second, retracted rest position out of the path of the deflected rod.

4. The device according to claim 3, wherein said rotary cutter mechanism is continuously driven independently of the position of the deflecting member, and in the rest position of said cutter mechanism said cutting member is housed within a substantially inaccessible hollow space.

5. The device according to claim 4, wherein said cutter mechanism is mounted onto a slide which is slidable on fixed guides transversely to the path of the deflected rod.

* * * * *